US005615587A

United States Patent [19]

Foerster, Jr.

[11] Patent Number: 5,615,587

[45] Date of Patent: Apr. 1, 1997

[54] DEEP-SOCKET DRIVER APPARATUS

[76] Inventor: Erwin W. Foerster, Jr., 6001 S. Yosemite, A-104, Englewood, Colo. 80111

[21] Appl. No.: 87,595

[22] Filed: Jul. 1, 1993

[51] Int. Cl.[6] ..... B25B 13/52

[52] U.S. Cl. ..... 81/64; 81/125; 81/124.2

[58] Field of Search ..... 81/64, 124.2, 125

[56] References Cited

U.S. PATENT DOCUMENTS 2,492,576 12/1949 James ..... 81/64 X 3,837,244 9/1974 Schera ..... 81/64

*Primary Examiner*—James G. Smith

*Attorney, Agent, or Firm*—Timothy J. Martin; Michael R. Henson

[57] ABSTRACT

A deep-socket driver apparatus is adapted to rotatably move a first one of a mated pair of threaded workpieces such as a nut along a second one of the mated pair of threaded workpieces such as a nut. The deep-socket driver apparatus comprises an elongated tubular body having a gripping end portion sized to releasably grip the first one of the mated pair of threaded workpieces. The elongated tubular body is operative to apply a frictional gripping force to the first one of the mated pair of threaded workpieces whereby the first one of the mated pair of threaded workpieces can rotatably move along the second one of the mated pair of threaded workpieces until a torque-resisting force overcomes the frictional gripping force causing slippage between the elongated tubular body and the mated pair of threaded workpieces. It is preferable that the elongated tubular body include a closed end portion disposed opposite the gripping end portion so that a stubshaft can be coaxially connected thereto. An adapter member is provided which releasably connects to the stubshaft at one end and receives a chuck of a conventional electric drill at an opposite end to impart rotational movement to the tubular body.

7 Claims, 3 Drawing Sheets

DEEP-SOCKET DRIVER APPARATUS

FIELD OF THE INVENTION

This invention relates to a tool adapted to rotate one of a mated pair of threaded workpieces about the other. More specifically, the present invention relates to a deep-socket driver apparatus which is particularly suited to rotate a threaded nut about a mated, threaded bolt.

BACKGROUND OF THE INVENTION

Many different types of fasteners have been used to fasten objects to a surface or another object. Matable pairs of threaded nuts and bolts have been commonly used to fasten objects together. To fasten objects blindly to vertically extending surfaces, such as a wall in a building structure, toggle bolts or molly bolts have been employed because the inner wall surface is often inaccessible. These types of bolts are particularly reliable when fastening a heavy object onto the wall. Although these bolts are reliable in lighter duty applications also, other viable alternatives exist. One such alternative is the invention described in my U.S. patent application Ser. No. 07/828,519 which was allowed for issuance on Jan. 12, 1993, and entitled "Fastener Device For Blind-End Mounting".

Generally, one embodiment of my patented fastener device includes a threaded shaft having a cross-piece hingedly connected thereto. My fastener device is typically fabricated from a resilient plastic material and it is used with a mated, threaded nut fabricated from metal or other material. It is possible that the user of my fastener device could damage or destroy the plastic threads when tightening the nut thereon. It is possible that the user might over-torque the nut by using, for example, a crescent wrench. Over-torquing the nut might result in either destroying the plastic threads or breaking the cross-piece off its threaded shaft. Therefore, a need exists to assist the user of my fastener device from over-tightening the nut onto my patented fastener device. It is from these considerations and others that the present invention involved.

SUMMARY OF THE INVENTION

It is an object of the present invention to provide a new and useful deep-socket driver apparatus for rotating nuts onto bolts, especially plastic bolts, while simultaneously avoiding problems associated with over-torquing the nut, thus preventing destruction of the threads on the shaft of the bolt or breakage of the Another object of the present invention is to provide such a deep-socket driver apparatus that is simple and inexpensive to manufacture.

It is yet another object of the present to provide such a deep-socket driver apparatus which releasably grips a threaded nut with sufficient frictional force to rotatably advance it onto or off of a mated threaded shaft.

Yet another object of the present invention is to provide such a deep-socket driver apparatus which, when turned in a first direction tightens and then slips about the workpieces when a torque-resisting force overcomes the frictional force yet which can loosen the workpiece when turned in an opposite direction.

Generally, the deep-socket driver apparatus is adapted to rotate a first one of a mated pair of threaded workpieces about a second one of the mated pair of threaded workpieces. Specifically, the deep-socket driver apparatus is particularly suited to rotate a threaded nut about a mated, threaded shaft of a plastic bolt.

In its broad form the deep-socket driver apparatus comprises an elongated tubular body which has a gripping end portion. The gripping end portion is sized to releasably grip the first one of the mated pair of threaded workpieces and is operative to apply a frictional gripping force to the first one of the mated pair of threaded workpieces. Having an appropriate size and an appropriate frictional gripping force, the first one of the mated pair of threaded workpieces can rotatably move along the second one of the mated pair of threaded workpieces until a torque-resisting force overcomes the frictional gripping force. When the torque-resisting force overcomes the frictional gripping force, slippage is caused between the elongated tubular body member and the mated pair of threaded workpieces. In one embodiment, the tubular body has a closed end portion which is disposed opposite the gripping end portion, and a stubshaft is coaxially connected to and extends from the closed end portion of the tubular body.

The gripping end portion of the elongated tubular body preferably includes a plurality of gripping segments with each of the gripping segments are separated from one another by a slot and is defined by opposing faces of the adjacent gripping segments. Each of the slots extends along the gripping end portion and may be formed substantially parallel to a central longitudinal axis of the elongated tubular body. Preferably, slots are substantially equidistantly spaced apart circumferentially around the gripping end portion. Furthermore, one of the opposing faces forming each slot is oriented coextensively in a first plane with the central longitudinal axis of the elongated tubular body while the other one of the opposing faces of adjacent gripping segments is oriented in a second plane disposed at an angle with respect to the first plane to form a gripping lip portion having a vertex disposed within the tubular chamber. The angle formed between the first and second planes is selected within a range of 0° to 75°. It is preferable that the tubular body be fabricated from a stiff yet resilient material such as plastic.

An adapter member can be adapted to releasably connect and impart rotational movement to the tubular body. The adapter member includes a neck portion and a cone portion. The neck portion has a first neck end portion operative to releasably connect to the tubular body and a second neck end portion disposed opposite the first neck end portion which is attached to the cone portion to form a funnel shape and the portion has a cone-shaped cavity formed therein. The neck portion of the adapter member includes a longitudinal hole extending into the first neck end portion, and this hole is configured to matably receive the stubshaft of the deep-socket driver apparatus. The hole and the stubshaft are configured substantially identically in cross-section typically as a polyhedron to facilitate the mechanical connection to impart rotational movement to the tubular body. It is again preferable that the adapter member be fabricated from a stiff yet resilient material; however, a rigid material would be adequate.

These and other objects of the present invention will become more readily appreciated and understood from a consideration of the following detailed description of the preferred embodiment when taken together with the accompanying drawings, in which:

DESCRIPTION OF THE EXEMPLARY EMBODIMENTS

Generally, a deep-socket driver apparatus of the present invention is adapted to rotatably move a first one of a mated pair of threaded workpieces along a second one of the mated pair of threaded workpieces. One of ordinary skill in the art would comprehend that the first one of the mated pair of threaded workpieces may be a common nut, and the second one of the mated pair of threaded workpieces may then be a bolt shaft. However, this comprehension should not limit the scope of the present invention. It is also possible that the first one of the mated pair of threaded workpieces is a screw with a hexagonal (or other polygonal) head and the second one of the mated pair of threaded workpieces is a structure into which the screw is to be fastened. In this instance, the deep-socket driver apparatus would engage the head of the screw so that it could be rotated into or out of the structure.

Figure 1:
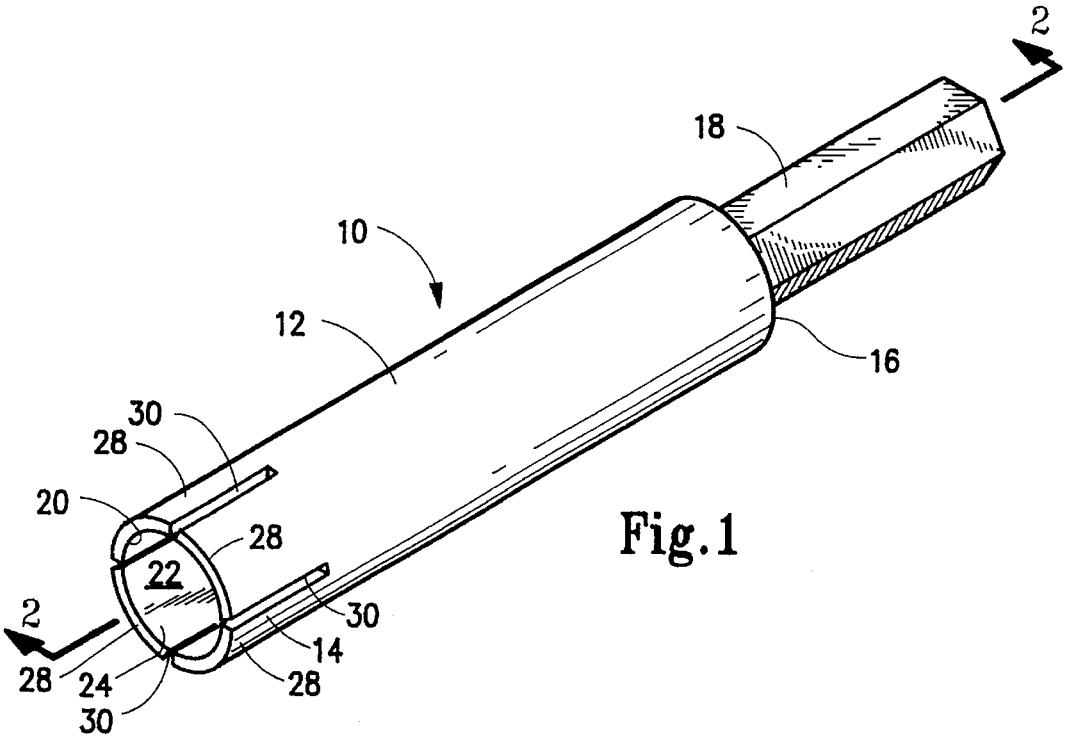
FIG. 1 is a perspective view of the first exemplary embodiment of the deep-socket driver apparatus.
Figure 2:
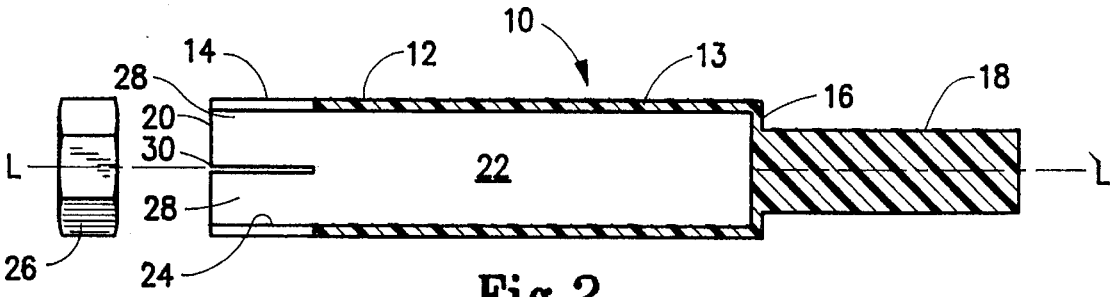
FIG. 2 is a cross-sectional side view shown along lines 2—2 of FIG. 1.

As best shown in FIGS. 1 and 2, a deep-socket driver apparatus 10 comprises an elongated tubular body 12 having a sidewall 13 surrounding a central longitudinal axis "L". The elongated tubular body 12 includes a gripping end portion 14 and a closed end portion 16 which is disposed opposite the gripping end portion 14. A stubshaft 18 is coaxially connected to and extends from the closed end portion 16 of the elongated tubular body 12 in a direction opposite of gripping end portion 14.

The gripping end portion 14 defines an opening 20 into an elongated tubularly-shaped chamber 22 which is defined by an inner wall 24 of the sidewall 13. As best shown in FIG. 2, the opening 20 is configured to receive a first one 26 of the workpieces which is shown for illustration purposes only as a common threaded nut. As one of ordinary skill in the art would appreciate this nut is the first one 26 of a mated pair of threaded workpieces.

In FIGS. 1 and 2, the gripping end portion 14 includes a plurality of gripping segments 28, each of which is separated from circumjacent gripping segments 28 by a slot 30. Each of the slots 30 extends radially through the sidewall 13 and longitudinally from the opening 20 along the gripping end portion 14. Each of the slots is oriented substantially parallel to the central longitudinal axis "L" of the elongated tubular body 12, that is, perpendicularly to a plane transverse to the central longitudinal axis. Alternatively, the slots 30 could be canted with respect to this transverse plane. In any event, the opening 20 is sized so that the gripping segments 28 can releasably grip the first one 26 of the mated pair of threaded workpieces and can operate to apply a frictional gripping force to the first one 26 of the mated pair of threaded workpieces.

Figure 3:
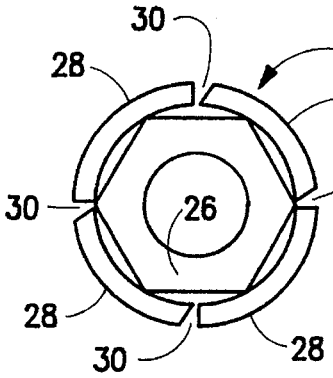
FIGS. 3, 4 and 5 are bottom views showing three different arrangements of gripping end segments and the slots therebetween for application with the present invention.
Figure 4:
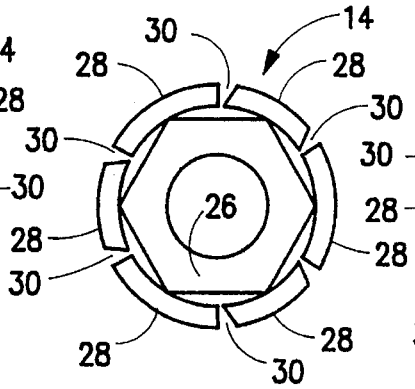
Figure 5:
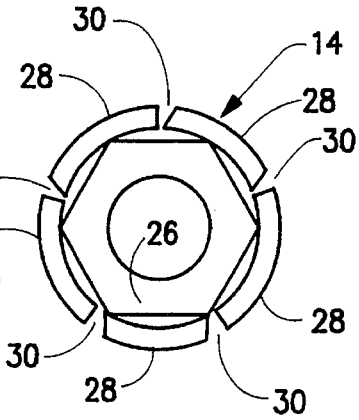

By way of example only, FIGS. 3, 4 and 5 illustrate three different arrangements of gripping segments 28 and slots 30 although other arrangements can be employed. In FIG. 3, four gripping segments 28 are intended to releasably grip the first one 26 of the mated pair of threaded workpieces such as a threaded nut. In FIG. 4, six gripping segments 28 are intended to releasably grip the first one 26 of the mated pair of threaded workpieces. In FIG. 5, five gripping segments 28 are intended to grip the first one 26 of the mated pair of threaded workpieces. As shown in FIGS. 3, 4 and 5, slots 30 are substantially equidistantly spaced-apart circumferentially around the gripping end portion 14.

Figure 6:
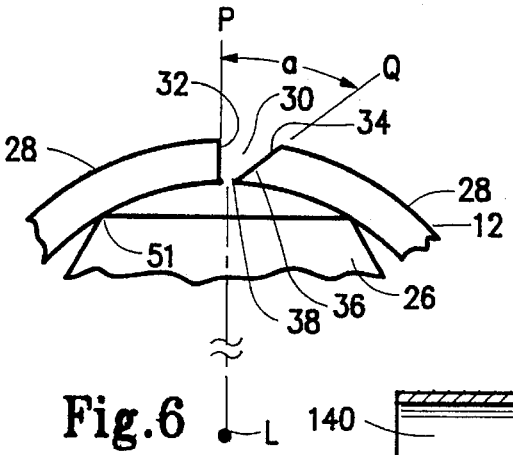
FIG. 6 is an enlarged fragmentary end view of two gripping segments and a slot therebetween.

As best shown in FIG. 6, each of the slots 30 is configured by opposing faces of adjacent gripping segments 28. Although not by way of limitation, a first flat face 32 of one of the adjacent gripping segments 28 is oriented in a radial plane "P" containing the central longitudinal axis "L" of the tubular body 12. For purposes of the preferred exemplary embodiment a second flat face 34 is opposite the first flat face 32 on an adjacent gripping segment 28 and is oriented in a plane "Q" that is canted at an angle "a" with respect to plane "P". The second flat face 34 thus forms a gripping lip portion 36 having a vertex 38 which is disposed within the tubularly-shaped chamber 22. Angle "a" formed between plane "Q" and plane "P" is selected within a range of 0° and 75°. Although the arrangement of slots 30 have been described with specificity, one of ordinary skill in the art would appreciate that other configurations may be equally as functional without departing from the spirit of the present invention.

Figure 7:
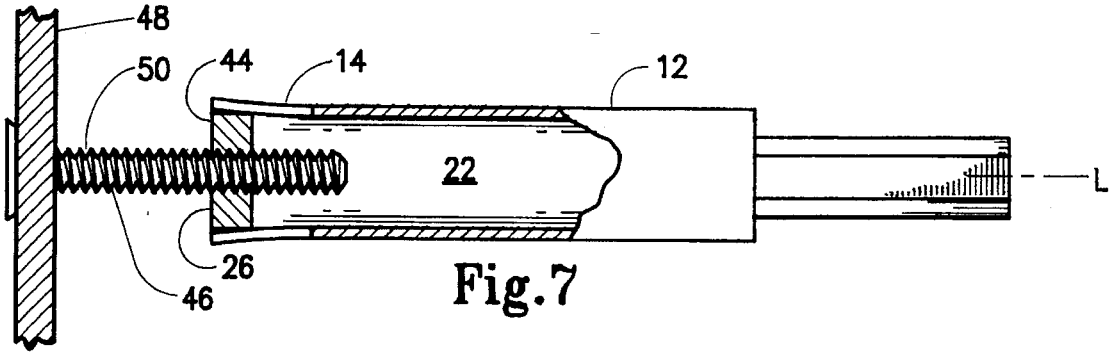
FIGS. 7 and 8 are side views in elevation and shown in consecutive sequence as to how the preferred exemplary embodiment of the present invention operates.
Figure 8:
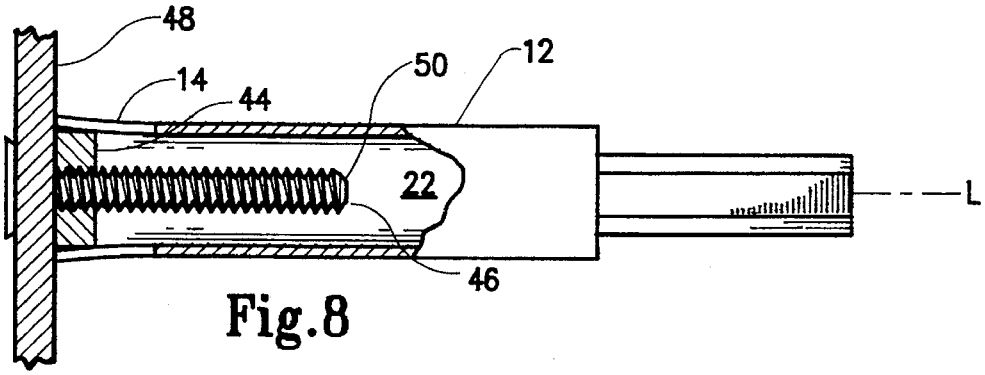

With reference to FIGS. 7 and 8, the deep-socket driver apparatus 10 of the present invention is adapted to rotatably move the first one of a mated pair of threaded workpieces along a second one 42 of the mated pair of threaded workpieces. For illustration purposes only, the first one 26 of a mated pair of threaded workpieces shall be a threaded metal nut 44 and the second one 42 of the mated pair of threaded workpieces shall be a plastic threaded bolt 46 protruding from a support surface 48 as shown in FIGS. 7 and 8. The nut 44 and bolt 46 are a mated pair of threaded workpieces 44 and 46. The elongated tubular body 12 has a gripping end portion 14 which is operative to releasably grip the first one 26 (or nut 44) of the mated pair of threaded workpieces so that, the first one 26 of the mated pair of threaded workpieces can rotatably move along the second one 42 (or bolt 46) of the mated pair of threaded workpieces. This rotational movement persists until a torque-resisting force overcomes the frictional gripping force, thus, causing slippage between the elongated tubular body 12 and the mated pair of threaded workpieces 26 and 42.

With reference to FIG. 6, as slippage occurs, a corner 51 of the first one 26 of the mated pair of threaded workpieces becomes entrapped, at least momentarily, within slot 30. It is believed that this entrapment increases, ratchet-like, the frictional gripping force which, in turn, could possibly continue rotational movement of the nut by overcoming the torque-resisting force. To this end, it is preferable that the deep-socket driver apparatus 10 be fabricated from a stiff, yet resilient material such as plastic. Such material affords the gripping segments 28 to flex as shown in FIGS. 7 and 8, thus, facilitating the capability to grip the first one 26 of the mated pair of threaded workpieces.

Figure 9:
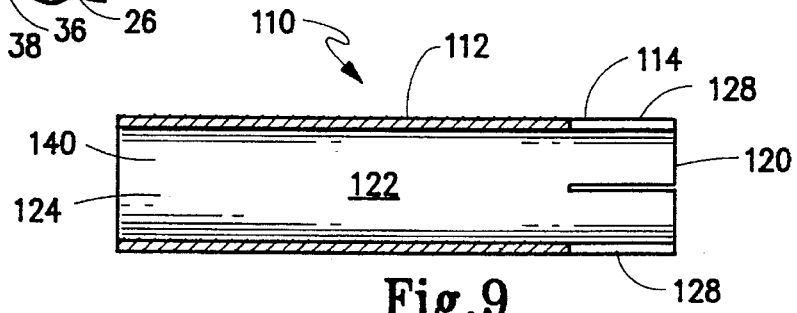
FIG. 9 is a side view in cross-section of a first alternative exemplary embodiment of the deep-socket driver apparatus of the present invention.

A first alternative exemplary embodiment of the present invention is shown in FIG. 9 as a deep-socket driver apparatus 110. This deep-socket driver apparatus 110 includes an elongated tubular body 112 having a gripping end portion 114. The gripping end portion 114 defines an opening 120 into a tubularly-shaped chamber 122 which is defined by an inner wall 124. The gripping end portion 114 includes a plurality of gripping segments 128 having a plurality of slots 130 disposed therebetween. Thus, the gripping end portion 114 is operative to releasably grip a first one of a mated pair of threaded workpieces. Since the deep-socket driver apparatus 110 is hollow, the end opposite the gripping end portion 114 defines a second opening 140. This first alternative exemplary embodiment could be particularly useful if the second workpiece is longer than tubular body 112.

Figure 10:
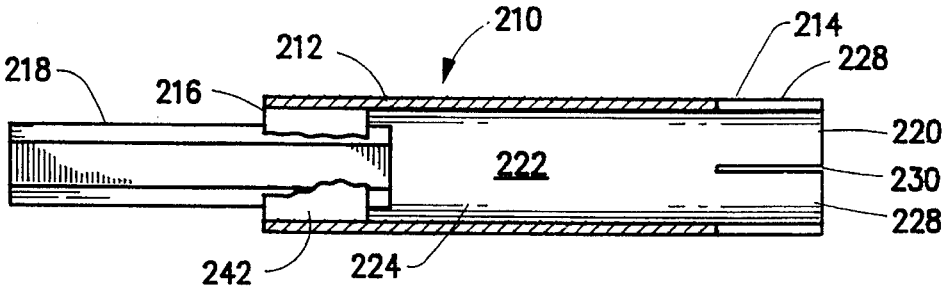
FIG. 10 is a side view in partial cross-section of a second alternative exemplary embodiment of the deep-socket driver apparatus of the present invention.

FIG. 10 shows a second alternative exemplary embodiment of a deep-socket driver apparatus 210 of the present invention. The deep-socket driver apparatus 210 includes an elongated tubular body 212 having a gripping end portion 214. Opposite the gripping end portion 214 is a closed end portion 216. The closed end portion 216 includes a stubshaft 218 which is retained within the tubular body 212 by a bushing 242. The gripping end portion 214 defines an opening 220 into a tubularly-shaped chamber 222. An inner wall 224 defines the tubularly-shaped chamber 222. The gripping end portion 214 includes a plurality of gripping segments 228 and a plurality of slots 230 disposed therebetween. Thus, the gripping end portion 214 is operative to releasably grip a first one of a mated pair of threaded workpieces.

Figure 11:
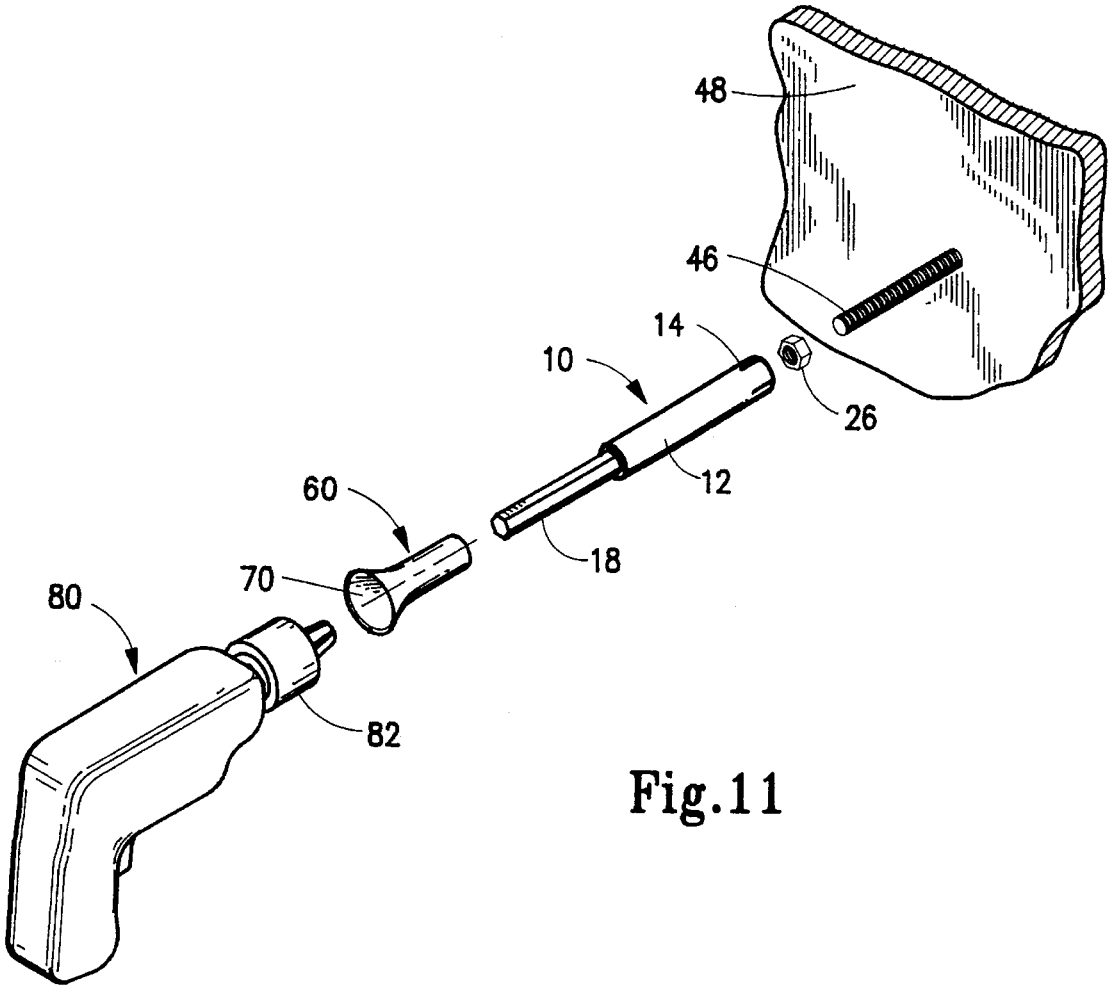
FIG. 11 is a perspective view illustrating the operation of an adapter member used in conjunction with the deep-socket driver apparatus of the present

One of ordinary skill in the art would appreciate that the deep-socket driver apparatus of the present invention could be rotated in several ways. First, the deep-socket driver apparatus could be rotated by hand. Second, an operator could rotate the deep-socket driver apparatus by engaging a conventional wrench to the stubshaft or a pipe wrench to the tubular body. Third, the deep-socket driver apparatus could be rotated electro-mechanically by using a conventional electric drill 80 with an adapter member 60 as illustrated in FIG. 11. The adapter member 60 is adapted to releasably connect and impart rotational movement to the tubular body 12 of the deep-socket driver apparatus 10. By way of example only, the adapter member 60, as hereinafter described, is particularly suitable to connect to the deep-socket driver apparatus 10 of the present invention having stubshaft 18.

Figure 13:
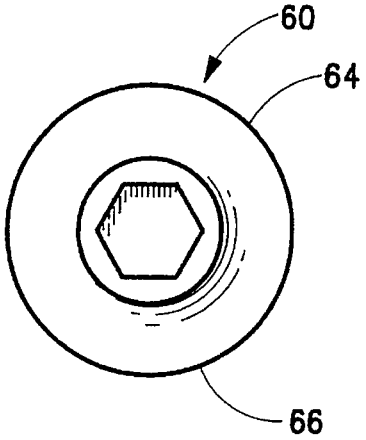
FIG. 13 is a bottom plan view of the adapter element shown in FIG. 12.
Figure 12:
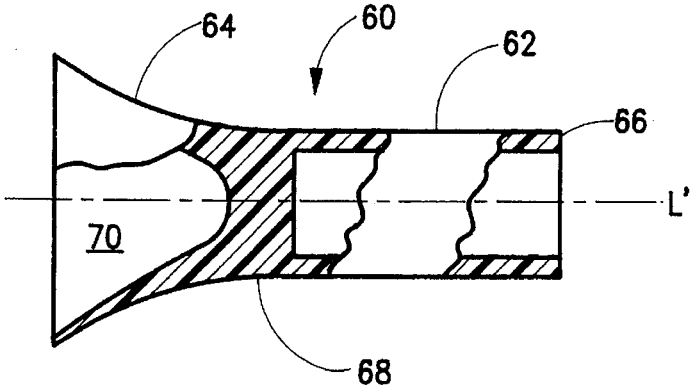
FIG. 12 is a side view in partial cross-section of the adapter member shown in FIG. 11.

With reference to FIGS. 12 and 13, the adapter member 60 includes a neck portion 62 and a cone portion 64. The neck portion 62 has a first neck end segment 66 which is operative to releasably connect to the stubshaft 18 of the deep-socket driver apparatus 10. A second neck end segment 68 disposed opposite the first neck end segment 66 is integrally attached to the cone portion 64. The cone portion 64 includes a cone-shaped cavity 70 which is adapted to receive a chuck 82 of the conventional electric drill 80 as shown in FIG. 11. As the electric drill 80 is pressed into the cone-shaped cavity 70, a frictional fit therebetween enables the rotating chuck 82 to drive the adapter member 60. A neck hole 72 extends longitudinally along a central longitudinal axis "L" from the first neck end segment 66 and through the neck portion 62. The neck hole 72 is configured to matably receive the stubshaft 18. It follows then that the neck hole 72 and the stubshaft 18 are configured substantially identical in cross-section. Such cross-sectional configuration might be a polyhedron.

The operation of the adapter member 60 in conjunction with the deep-socket driver apparatus 10 and the conventional electric drill 80 is shown in FIG. 11. The neck portion 62 of the adapter member 60 slideably receives the stubshaft 18 of the deep-socket driver apparatus 10. The cone-shaped cavity 70 receives the chuck 82 of the conventional electrical drill 80. Now, when the adapter member 60 is connected to the deep-socket driver apparatus 10 and the chuck 82 is inserted into the cone shaped cavity 70 of the adapter member 60, rotational movement can be imparted to the deep-socket driver apparatus 10 by operating the electric drill 80. The gripping end portion 14 of the deep-socket driver apparatus 10 releasably grips the nut 44. Upon contacting the nut 44 with the bolt 46 embedded into the support surface 48, rotational movement can be imparted to the adapter member 60, the deep-socket driver apparatus 10 and the nut 44 by operating the electric drill 80.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A deep-socket driver apparatus adapted to rotatably move a first one of a mated pair of threaded workpieces along a second one of the mated pair of threaded workpieces, comprising:

an elongated tubular body having a gripping end portion sized to releasably grip the first one of the mated pair of threaded workpieces and operative to apply a frictional gripping force to the first one of the mated pair of threaded workpieces whereby the first one of the mated pair of threaded workpieces can rotatably move along the second one of the mated pair of threaded workpieces until a torque-resisting force overcomes said frictional gripping force causing slippage between said elongated tubular body and the mated pair of threaded workpieces, said gripping end portion including a plurality of gripping segments with adjacent ones of said gripping segments being separated by a slot formed by opposing faces and wherein one of said opposing faces of said adjacent gripping segments is canted at an angle with respect to the other of said opposing faces.

2. A deep-socket driver apparatus according to claim 1 wherein said adapter member includes a neck portion and a cone portion, said neck portion has a first neck end segment operative to releasably connect to said stubshaft and a second neck end segment disposed opposite said first neck end segment and attached to said cone portion to form a funnel shape, said cone portion having a cone-shaped cavity formed therein.

3. A deep-socket driver apparatus according to claim 2 wherein said neck portion of said adapter includes a longitudinally-extending hole extending into said first neck end segment, said hole being configured to matably receive said stubshaft.

4. A deep-socket driver apparatus according to claim 3 wherein said hole and said stubshaft are configured substantially identically in cross-section as a polyhedron.

5. A deep-socket driver apparatus according to claim 1 wherein each of said slots extends substantially parallel to a central longitudinal axis of said elongated tubular body.

6. A deep-socket driver apparatus according to claim 1 wherein said slots are substantially equidistantly spaced apart circumferentially around said gripping end portion.

7. A deep-socket driver apparatus according to claim 1 wherein said angle formed between said first and second planes is selected within a range of 0° and 75°.

* * * * *